US005208603A

United States Patent [19]

Yee

[11] Patent Number: 5,208,603

[45] Date of Patent: May 4, 1993

[54] FREQUENCY SELECTIVE SURFACE (FSS)

[75] Inventor: James S. Yee, Seattle, Wash.

[73] Assignee: The Boeing Company, Seattle, Wash.

[21] Appl. No.: 539,018

[22] Filed: Jun. 15, 1990

[51] Int. Cl.[5] ..... H01Q 15/00; H01Q 1/42

[52] U.S. Cl. ..... 343/909; 343/872

[58] Field of Search ..... 343/700, 909, 872, 753, 343/754, 755, 767, 770, 771, 778

[56] References Cited

U.S. PATENT DOCUMENTS

| | | | |
|---|---|---|---|
| 4,125,841 | 11/1978 | Munk | 343/909 |
| 4,614,947 | 9/1986 | Rammos | 343/778 |
| 4,656,487 | 4/1987 | Sureau et al. | 343/909 |
| 4,816,835 | 3/1989 | Abiko et al. | 343/700 MS |
| 4,899,164 | 2/1990 | McGrath | 343/700 MS |
| 4,929,959 | 5/1990 | Sorbello et al. | 343/700 MS |

FOREIGN PATENT DOCUMENTS 1290454 2/1987 U.S.S.R. .

*Primary Examiner*—Rolf Hille
*Assistant Examiner*—Peter Toby Brown
*Attorney, Agent, or Firm*—John C. Hammar

[57] ABSTRACT

A frequency selective surface (FSS) for incorporation into the outer skin of an aircraft, for transmitting electromagnetic energy in a predetermined frequency band. The FSS includes three layers sandwiched together with a dielectric material. Arrays of apertures are formed in the two outer layers, which are conductive. The inner layer consists of patches of conductive material. The apertures and patches are in substantial alignment with one another. The apertures and patches can have the shapes of crossed-dipoles, circles, squares, tripoles and Jerusalem crosses. In a preferred embodiment, the shapes of the apertures and patches are geometrically congruent. A dual-band FSS, having apertures and corresponding patches in two different sizes and spacings, can transmit two separate frequency bands.

5 Claims, 5 Drawing Sheets

FIG. 1
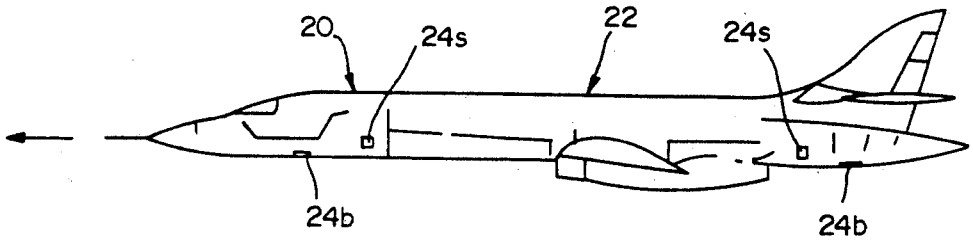
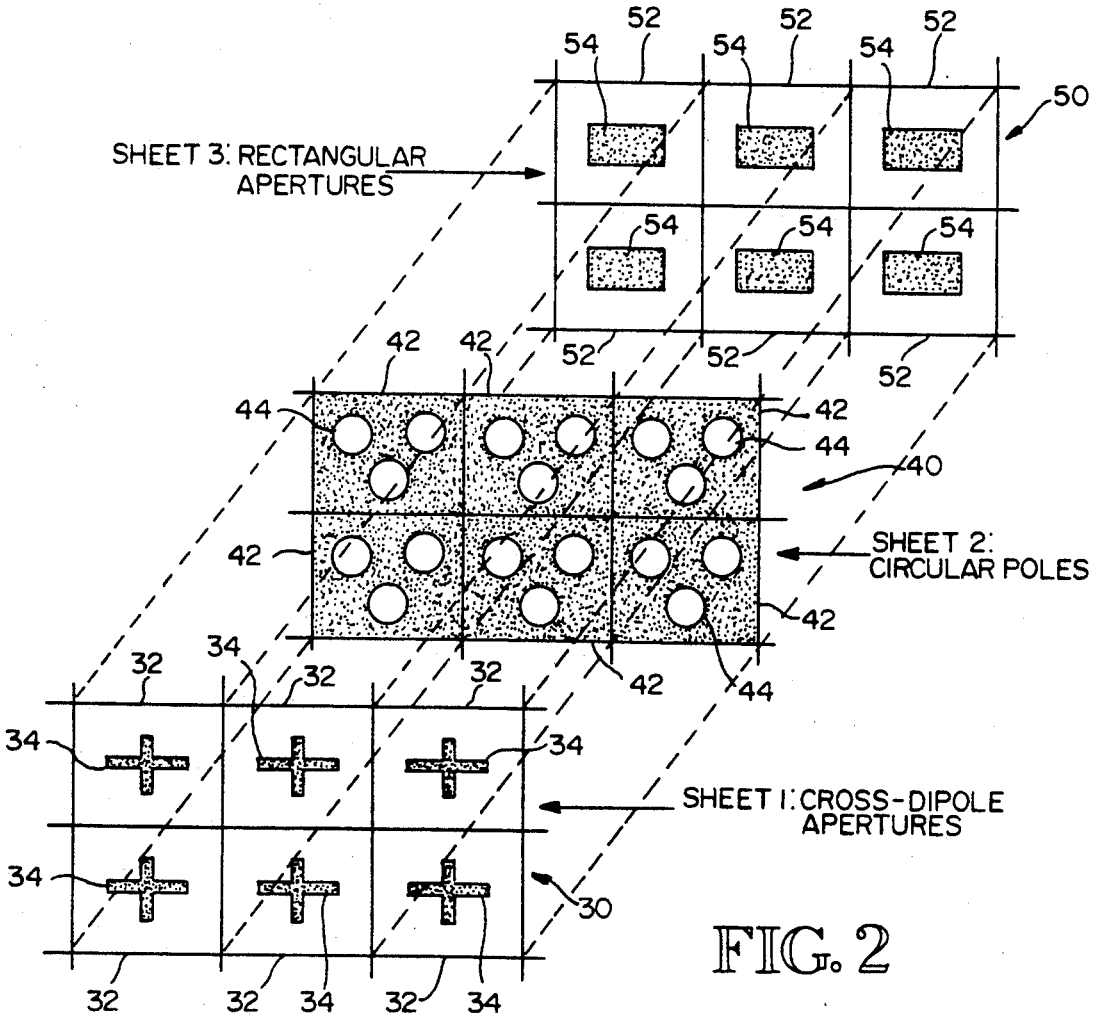
FIG. 2

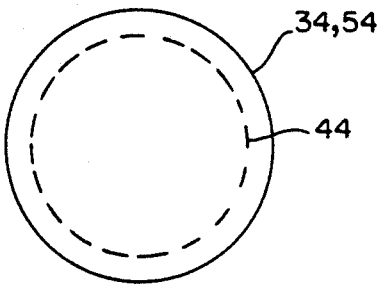
FIG. 3B
FIG. 3A
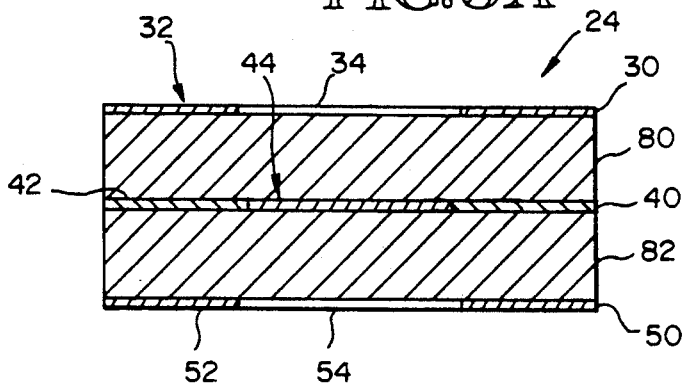
FIG. 4
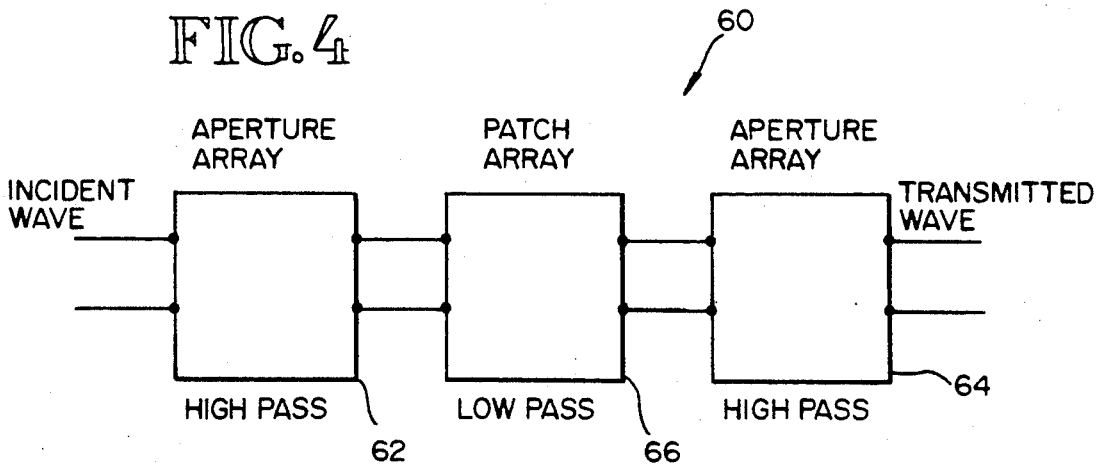

SKEW LATTICE (Ω ≠ 90°)

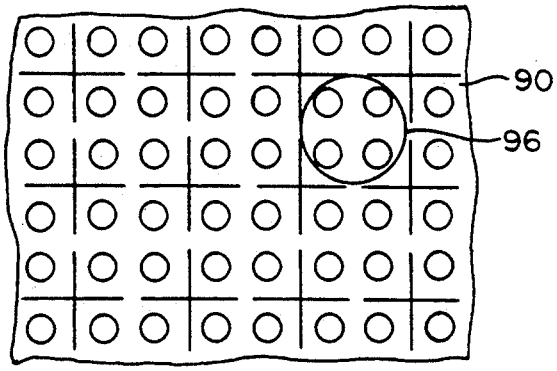
FIG. 6C
FIG. 6D
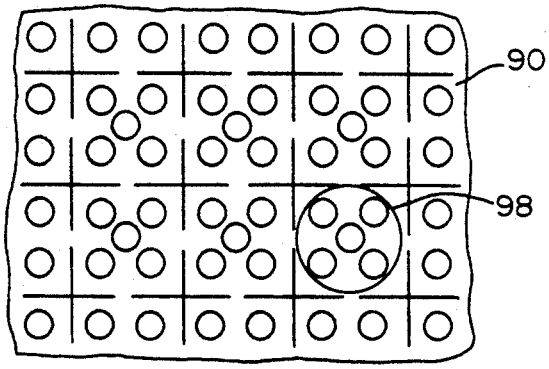
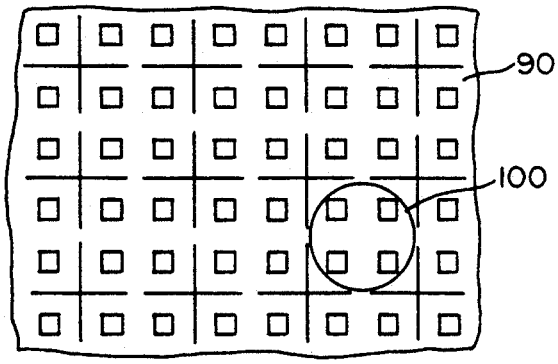
FIG. 6E

FREQUENCY SELECTIVE SURFACE (FSS)

GOVERNMENT RIGHTS

This invention was made with Government support under Contract No. F19628-88-C-0155 awarded by the United States Air Force. The Government has certain rights in this invention.

DESCRIPTION

1. Technical Field

The present invention relates to surfaces for transmitting electromagnetic energy, and more particularly, to surfaces that permit the selective transmission of a predetermined frequency band of electromagnetic energy.

2. Background of the Invention

The typical outer skin of an aircraft is designed to serve structural and aerodynamic purposes. The performance of avionic systems on the aircraft is not a primary factor. Therefore, antennas for avionics systems are generally placed after the outer skin of the aircraft has been determined. Frequently this involves the placement of antenna systems on the outer skin of the aircraft.

The need for increasing aircraft speed and maneuverability has been comprised by the placement of avionics antennas. While antenna systems that are conformal to the fuselage are known, they generally introduce weaknesses to the aircraft fuselage. Therefore, it is desirable to produce a fuselage surface which can transmit electromagnetic radiation without affecting the aerodynamics of the aircraft or introducing weaker areas in the outer skin. It is particularly desirable to produce a frequency selective surface (FSS) which is capable of transmitting electromagnetic radiation in one or more predetermined frequency bands while reflecting others. This can provide protection to electronic systems that are sensitive to certain electromagnetic frequencies while needing access to others. FSS characteristics also lead to wide-spread applications in electromagnetic energy filters used in reflectors, radomes, and other devices in microwave, millimeter wave, and even optical frequencies.

There are currently many choices of FSS elements available to satisfy a FSS requirement. However, generally, a FSS is a multi-layered surface consisting of two or more layers of FSS elements with each layer separated by a layer of dielectric material of proper permittivity and thickness. While some FSSs can produce excellent computed performance characteristics, they can become very difficult and costly when it comes to actually making them. In addition, their measured performance often does not agree with their computed performance. On the other hand, the FSS of the present invention can be easily built, and the agreement between the experimental and theoretical results has been excellent.

A predecessor frequency selective surface (FSS) made from conventional FSS elements is described in a copending patent application Ser. No. 825,184, entitled "Microstrip Frequency Selective Surface for Narrow Bandpass Radomes, Antenna Windows and the Like", filed on Nov. 15, 1985. The present invention results from continuing research into FSSs, in which it was discovered that an "inverse" (or aperture/patch/aperture) design of the original FSS concepts worked as well as, or better than, the original design. This "inverse" design produces similar frequency selective characteristics but with better-defined bandpass characteristics.

The FSS of the present invention includes FSS "elements." The unique features of the FSS elements are that they can be thin and lightweight. They can also be easily built currently available circuit board and radome technology techniques at low cost. In addition, these elements can be built to conform with complex vehicle surfaces with excellent structural and weight bearing characteristics.

"Inverse" FSSs made from such FSS elements offer good physical characteristics in many special application situations. The physical characteristics are:

1. With the exception of small discrete periodic apertures on the top and bottom layers of the FSS, those two layers are essentially continuous metallic surfaces. This adds strength to the overall FSS structure due to the stronger metallic surfaces.

2. The outer metallic layer in the FSS will offer a smoother electromagnetic junction transition to a vehicle metallic skin. This significantly reduces electromagnetic scattering due to junction discontinuities.

3. The inverse configuration is better for use in a high temperature environment because the double metallic outer surfaces will conduct excess heat away more efficiently.

4. Electromagnetic pulse (EMP) and lightning protection is enhanced by virtue of the continuous outer surfaces.

SUMMARY OF THE INVENTION

It is an object of the present invention to provide a frequency selective surface that is thin and lightweight.

It is another object of the present invention to provide a frequency selective surface that can be easily built with currently available circuit board and radome technology techniques.

It is a further object of the present invention to provide a frequency selective surface that can be built to conform with complex surfaces.

It is an additional object of the present invention to provide a frequency selective surface that can be built into a composite structure with excellent structural and weight bearing characteristics.

Another object of the present invention is to provide a frequency selective surface that transmits electromagnetic energy having wavelengths within a predetermined range while rejecting electromagnetic energy outside of the predetermined range.

A still further object of the present invention is to provide a dual frequency selective surface that transmits electromagnetic energy having wavelengths within two distinct predetermined ranges while rejecting electromagnetic energy outside of the predetermined range.

Yet another object of the present invention is to provide a radome that transmits electromagnetic energy having wavelengths within a predetermined range.

According to one aspect, the present invention is a frequency selective surface for transmitting electromagnetic energy at a predetermined wavelength. The frequency selective surface comprises first and second conductive sheets. Each of the sheets has a predetermined pattern of apertures formed therein. Each pattern is a function of the predetermined wavelength. The sheets are spaced apart from one another so that the pattern of apertures in each sheet is aligned with the pattern of apertures in the other sheet.

The frequency selective surface further comprises a substrate placed between the first and second conductive sheets. The substrate has a predetermined pattern of conductive patches aligned with the patterns of apertures in the first and second conductive sheets. The predetermined pattern of patches is also a function of the predetermined wavelength. In addition, the frequency selective surface comprises dielectric material separating the substrate from the first and second conductive sheets.

In another aspect, the invention is a dual band frequency selective surface for transmitting electromagnetic energy at a predetermined longer wavelength and a predetermined shorter wavelength. The dual band frequency selective surface comprises first and second conductive sheets, each sheet having the same predetermined pattern of apertures therein. The pattern includes a first set of large widely-spaced apertures and a second set of small closely spaced apertures. The first set of large widely-spaced apertures is a function of the predetermined longer wavelength, and the second set of small closely-spaced apertures is a function of the predetermined shorter wavelength. The sheets are spaced apart from one another so that the pattern of apertures in each sheet is aligned with the pattern of apertures in the other sheet.

The dual band frequency selective surface also comprises a substrate placed between the first and second conductive sheets. The substrate has a predetermined pattern of conductive patches aligned with the patterns of apertures in the first and second conductive sheets. The dual band frequency selective surface further comprises dielectric material separating the substrate from the first and second conductive sheets.

BRIEF DESCRIPTION OF THE DRAWINGS

FIG. 1 is a schematic diagram of an airplane, showing the frequency selective surface (FSS) of the present invention.

FIG. 2 is an exploded view of a first embodiment of an FSS according to the present invention, the frequency selective surface including a plurality of unit cells.

FIG. 3A is a cross-sectional schematic diagram of a first embodiment of a unit cell in an FSS, the unit cell containing a circular aperture.

FIG. 3B is a plan view of the first embodiment of the unit cell of the FSS of FIG. 3A.

FIG. 4 is a schematic diagram of an equivalent electrical model of the FSS of the present invention.

FIG. 6C is a plan view of a third embodiment of a unit cell in a dual frequency selective surface, the unit cell containing a large crossed dipole aperture for operation at a longer wavelength and four small circular apertures for operation at a shorter wavelength.

FIG. 6D is a plan view of a fourth embodiment of a unit cell in a dual frequency selective surface, the unit cell containing a large crossed dipole aperture for operation at a longer wavelength and five small circular apertures for operation at a shorter wavelength.

FIG. 6E is a plan view of a fifth embodiment of a unit cell in a dual frequency selective surface, the unit cell containing a large crossed dipole aperture for operation at a longer wavelength and four small square apertures for operation at a shorter wavelength.

DETAILED DESCRIPTION OF THE INVENTION

Figure 5:
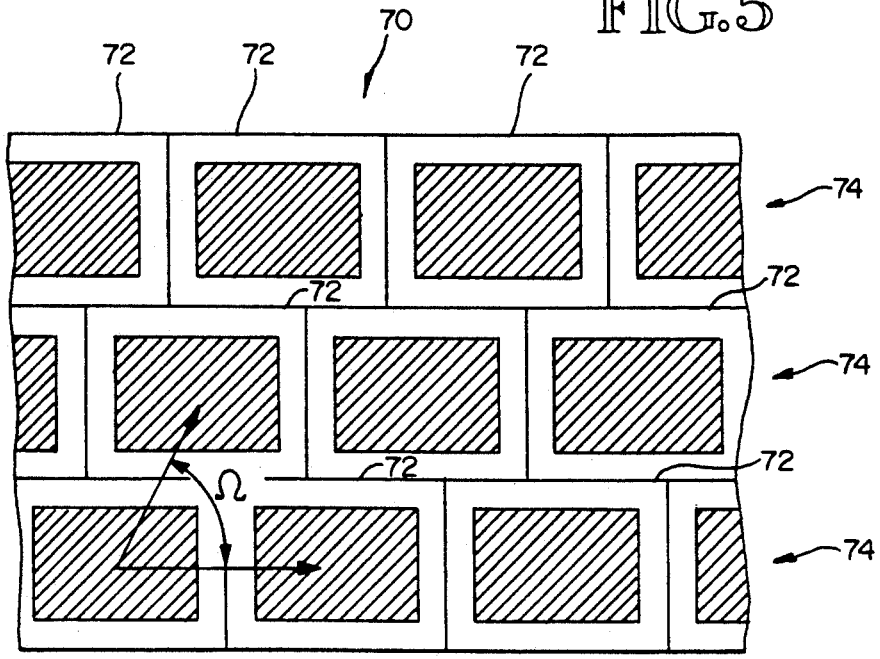
FIG. 5 is a schematic diagram of a second embodiment of an FSS according to the present invention, including a plurality of skewed unit cells.

FIG. 1 is a schematic diagram of an airplane, showing the frequency selective surface of the present invention. The airplane 20 includes a fuselage 22 made from an outer skin that is shaped to provide the desired aerodynamic characteristics. The fuselage 22 contains avionics systems (not shown) that are required to transmit electromagnetic energy to or to receive electromagnetic energy from the exterior of the airplane 20. The avionics systems are located within the fuselage 22 to transmit toward or to receive from a desired direction through an FSS 24. Each FSS 24 is located within a predefined area on the fuselage 22 and is conformal with the surrounding areas of the fuselage 22 to permit the designed aerodynamic performance of the airplane 20 to be achieved. FSSs 24 can be located at any desired point on the fuselage 22 to allow transmission to or from any particular direction. For example, the FSSs **24*b* are located to facilitate transmissions to or from below the airplane 20, while the FSSs 24*s* are located to facilitate transmissions to or from the side of the airplane 20**.

FIG. 2 is an exploded view of a first embodiment of an FSS 24. A structure of this sort can be referred to as an "aperture/patch/aperture" FSS. An FSS 24 comprises first, second and third layers, or sheets, respectively 30, 40 and 50. The sheets are held together in a close parallel structure by means of dielectric sheets placed between the sheets 30, 40 and 50. The first sheet 30 is made from a conductive material which has been divided into a plurality of unit cells 32. The unit cells 32 fit together in a predetermined pattern, such as a rectangular pattern. Each unit cell 32 has an aperture pattern 34 (for example, a cross-dipole aperture) formed therein.

The second sheet 40 contains a plurality of unit cells 42 that correspond to the unit cells 32 in the first sheet 30. Each of the unit cells 42 contains a pattern 44 of patches (for example, a triangular array of circular patches) formed therein. The third sheet 50 contains a plurality of unit cells 52 that correspond to the unit cells 32 in the first sheet 30 and the unit cells 42 in the second sheet 40. Each of the unit cells 52 contains a pattern 54 of apertures (for example, a rectangular aperture) formed therein.

FIG. 3A is a cross-sectional schematic diagram of a first embodiment of the unit cells 32, 42 and 52 in the first, second and third sheets 30, 40 and 50 of the FSS 24. FIG. 3B is a plan view of the first embodiment of the unit cells of the FSS 24. The unit cells 32 and 52, formed on the conductive sheets 30 and 50, each contain a circular aperture, respectively, apertures 34 and 54, which are aligned. The circular patch 44 is also aligned with the apertures 34 and 54. The sheet 40 is sandwiched between and spaced apart from the sheets 30 and 50 by dielectric layers 80 and 82. In some configurations, it has been found desirable to make the patch 44 with slightly different characteristic dimensions than either of the two apertures 34 and 54.

The apertures 34 and 54 can be formed in any desired shapes including circles, crossed-dipoles, Jerusalem crosses, tripoles, squares, or combinations and other configurations thereof known to those skilled in the art.

FIG. 4 is a schematic diagram of an equivalent electrical model 60 which explains the operation of the aperture/patch/aperture FSS 24. The electrical model includes three elements, each corresponding to one of the sheets 30, 40 and 50 in FIG. 2.

The explanation of the aperture/patch/aperture FSS 24 involves two basic concepts in electromagnetics. The first concept is that an aperture array, known as an inductive screen, behaves electrically like a high pass filter. The two aperture arrays on the first and third sheets 30 and 50 (see FIG. 2) are signified symbolically by the filter characteristics of the two high pass filters 62 and 64. The second concept needed is that a patch array, known as a capacitive screen, behaves electrically like a low pass filter. The patch array on the second sheet 40 (see FIG. 2) is signified symbolically by the filter characteristics of the low pass filter 66.

If the spacings of the unit cells on adjacent aperture and patch arrays are the same, the cutoff frequency of the low pass filter (patch array) is higher than the cutoff frequency of the high pass filter (aperture array). Therefore, when an electromagnetic wave excites the first aperture array at frequencies above its high pass cutoff, the first aperture array sets up electric currents in the middle patch array at frequencies below the cutoff of the corresponding low pass filter. These currents, in turn, excite the second aperture array and causes it to radiate at frequencies between the two cutoff frequencies. The middle patch array provides the coupling mechanism to link the first aperture array and the second aperture array. Together, the three arrays provide the desired bandpass characteristics.

There are many design approaches to satisfying a specific FSS requirement, some using sophisticated computer codes to aid in the design. A theoretical computer-based formulation to aid FSS design was prepared in the form of integral equations and appropriate dyadic Green's functions. The method-of-moments was used in the numerical solution for the unknown patch currents and the unknown aperture fields. In that study, using the patch/aperture/patch model, entire-domain (global) basis functions were used to represent the unknown quantities. The computer program was developed from the numerical solutions. Results from the computer code showed good agreement with experimental data. The aperture/patch/aperture configuration offers some unique physical characteristics that are superior to those in the patch/aperture/patch configuration.

Some empirical work was also conducted in the design of a dual-band FSS, using circular FSS elements. Experimental dual-band FSSs show good low band performance, but use high-band element spacings that give rise to scattering grating lobes. Although the simple circular patch elements were useful for examination of phenomena associated with the FSS and for development/checkout of computer models, they have not been shown to fully satisfy the requirements for a dual-band structure. Therefore, it is helpful to impose a primary constraint on element spacing such that the scattering grating lobes will not appear in the visible region of space. This constraint is that the characteristic element spacing must be less than one-half of the free space wavelength of the operating frequency. In addition to the grating lobe concern, the frequency roll-offs of the pass-band transmission characteristics can be improved either by internal staggered tuning of the aperture/patch/aperture arrays themselves or by cascade tuning of additional FSSs. Also, surface wave effects are intimately related with the dielectric environment in which the aperture/patch/aperture arrays are imbedded.

FIG. 5 is a schematic diagram of a second embodiment 70 of an FSS 24 according to the present invention. Each sheet in the second embodiment includes a plurality of skewed unit cells 72 which are arranged in rows 74. The unit cells 72 on one sheet in the FSS 24 are aligned with the unit cells 72 on each of the other two sheets in the FSS 24. In the embodiment of FIG. 5, each of the unit cells 72 in a given row 74 is skewed with respect to corresponding unit cells 72 in an adjacent row 72 by an angle $\Omega$, measured with respect to the alignment of the row 72.

Five embodiments of dual-band FSSs are shown in plan view in FIGS. 6A–6E. Each configuration is built up using the basic concept of the present invention. For a dual-band FSS, the preliminary design methodology is to include elements of two different sizes within a unit cell. The unit cell has a single large element whose dimensions are chosen so that it resonates at the lower frequencies of the dual frequency band. On the other hand, the smaller elements are packed in such a fashion that they will resonate at the higher frequencies.

A low-band crossed dipole element 90 is common to all three sheets in each embodiment of the dual-band FSSs. The low-band element configuration shown in each of the FIGS. 6A–6E allows close packing of the high-band elements to satisfy the element spacing constraint that avoids grating lobes. Since the element dimensions for resonance are generally 30 to 40% smaller than the normal half-wavelength lengths in the thin closely coupled aperture/patch/aperture combination, it is possible to have the low-band crossed dipoles spaced less than a half wavelength apart, thus again satisfying the grating-lobe-free element spacing requirement.

Figure 6A:
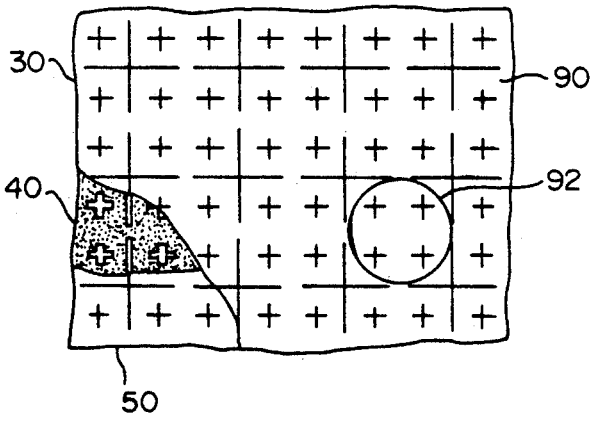
FIG. 6A is a plan view of a first embodiment of a dual-band FSS, each unit cell thereof containing a large crossed dipole aperture for operation at a longer wavelength and four small crossed dipole apertures for operation at a shorter wavelength.
Figure 6B:
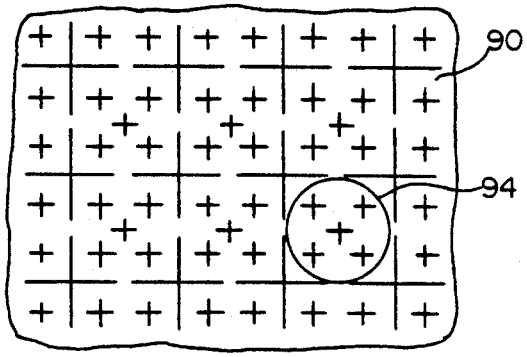
FIG. 6B is a plan view of a second embodiment of a unit cell in a dual frequency selective surface, the unit cell containing a large crossed dipole aperture for operation at a longer wavelength and five small crossed dipole apertures for operation at a shorter wavelength.

The configurations in FIGS. 6A–6E differ in the type and combination of the high frequency elements. In FIG. 6A the high frequency elements are formed in a configuration of four closely-spaced crossed-dipoles 92. In contrast, the high frequency elements in FIG. 6B are formed in a configuration of five closely-spaced crossed-dipoles 94. The fifth crossed-dipole is placed to assure that no grating lobes will emerge in the off-cardinal planes, as discussed above in connection with the calculated performance of the FSS. At the same time, the fifth crossed-dipole improves the transmission efficiency at the high band by virtue of the added elements.

FIG. 6C shows the high frequency elements to be formed in a configuration of four close-spaced circles 96, while in FIG. 6D, the high frequency elements are formed in a configuration of five close-spaced circles 98. Finally, in FIG. 6E, the high frequency elements are formed in a configuration of four closely-spaced squares 100.

Although the performance of the aperture/patch/aperture combinations of crossed dipoles, circular patches, and square patches FSS elements are similar in many ways, the final selection of the high-band elements will involve fine tuning the characteristics of each of the three types. There are many more crossed dipole variations available for further consideration, including tripoles and Jerusalem crosses.

Figure 7:
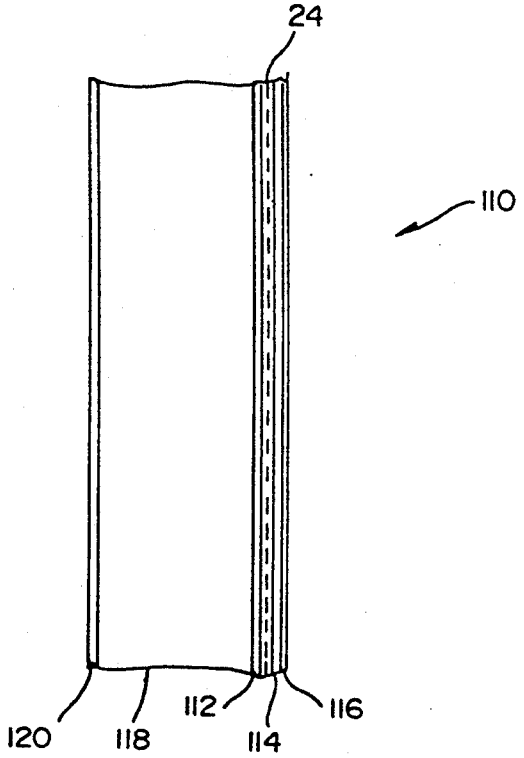
FIG. 7 is a cross-sectional view of a radome incorporating a FSS of the present invention.

FIG. 7 is a cross-sectional view of a radome incorporating a FSS of the present invention. In the radome 110, the FSS 24 is thin, having a thickness of approximately 0.025 inch. The FSS 24 is surrounded by two tough protective dielectric skins 112 and 114, each having a thickness in the range of approximately 0.020 inch to 0.030 inch. The outer side of the radom 110, which will be exposed to the ambient atmosphere (to the right in FIG. 7), is coated with a thin conventional rain erosion coating 116. The rain erosion coating 116 can be less than 0.020 inch thick. The strength of the radome 110 can be improved by adding a layer 118, made from a conventional honeycomb material to the radome's inner side (to the left in FIG. 7). The layer 118 can be 0.5 inch thick. The honeycomb material has a dielectric constant of approximately 1.0. To protect the layer 118 from wear, it can be coated by a further tough protective dielectric skin 120. The dielectric skins 112, 114 and 120 are made from a material that has both low electric loss and high mechanical strength.

Transmission characteristics of dual-band FSSs at low and high bands occur at or near the resonance frequencies of the two different sizes of apertures and patches. Since the apertures and patches are imbedded in dielectric layers, their actual sizes are smaller than those in free space. This helps to reduce their spacing and eliminate grating lobes. The resonant frequencies depend on the dielectric constant and the element shape. The dielectric constants of the two sets of dielectric layers, layers 114 and 116 and layers 112 and 118, are chosen to properly compensate for the various incidence angles and polarizations of the electromagnetic energy. Past experience has shown that grading the dielectric constant will provide a better electromagnetic match between the surrounding environment and the radome 110.

The element shape's dependence on the angle of incidence of the transmitted energy is affected greatly by its shape. For example, the Jerusalem cross is known to be less sensitive to the angle of incidence than other standard elements. The resonant frequencies for patches may be slightly different than that for the apertures of the same shape. While the half-wavelength of the resonant frequency of a patch corresponds closely to the patch's size, the resonant frequency of a congruent aperture can be close but different. The resonant frequency of an aperture may depend also on the spacing between the apertures where the currents and charges are distributed. In the past, the patches and apertures have been the same size, but the above considerations have determined that the optimum design may require that the patches and apertures be of slightly different sizes.

The elimination of grating lobes requires closer packing of the elements. This can be accomplished by employing appropriate shapes for patches and apertures and a higher dielectric constant. The grating lobes can also be reduced by a skewed arrangement of periodic structures. For example, the arrangement of Jerusalem cross and tripole elements can be optimized.

While the foregoing has been a discussion of two specific embodiments of the present invention, those skilled in the art will appreciate that numerous modifications to the disclosed embodiments can be made without departing from the spirit and scope of the invention. Accordingly, the invention is to be limited only by the following claims.

I claim:

1. A frequency selective surface for transmitting a discrete frequency of incident electromagnetic energy, comprising:

slots in spaced conductive sheets aligned with one another and separated by a solid dielectric material, the slots being tuned at a discrete frequency to function as a high pass filter; and a patch element within the dielectric material tuned to the discrete frequency and functioning as a low pass filter for passing energy received by one slot to the other slot through the dielectric material.

2. A frequency selective surface element for transmitting a discrete frequency of incident electromagnetic energy, comprising:

(a) a first conductive ground plane including a first aperture of a predetermined size and shape tuned to receive energy at the discrete frequency and functioning as a high pass filter;

(b) a layer of solid dielectric material attached to the ground plane;

(c) a patch shaped and sized to substantially match the first aperture for coupling with the discrete frequency and functioning as a low pass filter, the patch being positioned on the dielectric layer aligned with and remote from the first aperture;

(d) a second layer of dielectric material overlying the patch; and (e) a second conductive ground plane having a second aperture of a predetermined size and shape tuned to the discrete frequency, the second aperture being aligned with and remote from the patch and first aperture on the second dielectric layer so that incident electromagnetic energy at the discrete frequency is transmitted through the surface from the first aperture to the patch to the second aperture.

3. A frequency selective surface comprising a plurality of the elements of claim 2 arranged in a predetermined geometric pattern.

4. A frequency selective surface element for transmitting two discrete frequencies of incident electromagnetic energy comprising a sandwich structure having outer ground planes of conductive material around a central patch plane, the ground planes being isolated from the patch plane and from each other by a solid dielectric material and having analogous, high pass apertures aligned with one another, each ground plane including a first aperture of predetermined size and shape tuned to a first frequency and a second aperture of different size and shape tuned to a second frequency, the patch plane functioning as a low pass filter and including a first patch element being the inverse of the first aperture and a second patch element being the inverse of the second aperture, the patch elements being aligned with the respective apertures of the ground planes and being electrically isolated from one another.

5. A frequency selective surface tuned to pass either or both of two predetermined frequencies comprising a plurality of elements of claim 4 arranged in a predetermined geometric pattern.

* * * * *